US007287497B2

(12) United States Patent
Sun et al.

(10) Patent No.: US 7,287,497 B2
(45) Date of Patent: Oct. 30, 2007

(54) ENGINE VALVE ACTUATION SYSTEM AND METHOD

(75) Inventors: Zongxuan Sun, Troy, MI (US); Tang-Wei Kuo, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 93 days.

(21) Appl. No.: 11/341,282

(22) Filed: Jan. 27, 2006

(65) Prior Publication Data

US 2006/0236958 A1 Oct. 26, 2006

Related U.S. Application Data

(60) Provisional application No. 60/674,213, filed on Apr. 22, 2005.

(51) Int. Cl.
*F01L 9/02* (2006.01)

(52) U.S. Cl. ..... 123/90.12; 123/90.15; 123/90.16; 123/90.2; 123/90.31

(58) Field of Classification Search ..... 123/90.12
See application file for complete search history.

(56) References Cited

U.S. PATENT DOCUMENTS

| | | | | |
|---|---|---|---|---|
| 6,082,342 | A | 7/2000 | Duret et al. | 123/568.14 |
| 6,386,177 | B2 | 5/2002 | Urushihara et al. | 123/299 |
| 6,510,824 | B2 * | 1/2003 | Vorih et al. | 123/90.12 |
| 6,941,909 | B2 * | 9/2005 | Robel et al. | 123/90.16 |
| 7,162,996 | B2 * | 1/2007 | Yang | 123/321 |

FOREIGN PATENT DOCUMENTS

| | | |
|---|---|---|
| WO | WO0146571 | 6/2001 |
| WO | WO0146572 | 6/2001 |
| WO | WO0146573 | 6/2001 |

* cited by examiner

*Primary Examiner*—Thomas Denion
*Assistant Examiner*—Kyle M. Riddle

(57) ABSTRACT

The present invention provides a valve actuation system for an internal combustion engine. The valve actuation system of the present invention may provide an increased range of auto-ignition operation by providing a valve re-opening mechanism to provide products of combustion into the cylinder to increase the thermal efficiency and stability of the auto-ignition combustion process. The present invention allows the poppet valve re-opening timing, lift and duration to be tailored to specific engine architecture and operating conditions. Additionally, the present invention provides a method of re-opening a poppet valve of an internal combustion engine.

12 Claims, 1 Drawing Sheet

ENGINE VALVE ACTUATION SYSTEM AND METHOD

CROSS REFERENCE TO RELATED APPLICATION

This application claims the benefit of U.S. Provisional Application No. 60/674,213, filed Apr. 22, 2005, which is hereby incorporated by reference in its entirety.

TECHNICAL FIELD

The present invention relates to a valve actuation system for an internal combustion engine.

BACKGROUND OF THE INVENTION

Dilute combustion of gasoline in an internal combustion engine, using either air or recirculated exhaust gas, can enhance the thermal efficiency and decrease the production of oxides of Nitrogen (NOx). However, there is a limit to which an internal combustion engine may operate with a dilute mixture due to misfire and combustion instability resulting from a slow burn rate of the dilute mixture. Known methods to extend the dilution tolerance limit include: 1) improving the ignitability of the mixture by enhancing ignition and mixture preparation, 2) increasing the flame speed by introducing charge motion and turbulence, and 3) operating the engine in a controlled auto-ignition combustion mode.

The controlled auto-ignition process may be referred to as Homogeneous Charge Compression Ignition (HCCI). In this process, a charge mixture of combusted gases, air, and fuel is created and auto-ignition is initiated simultaneously from multiple ignition sites within the compressed charge mixture, thereby resulting in stable power output and high thermal efficiency. Since the combustion is highly dilute and uniformly distributed throughout the charge mixture, the temperature of the burnt gas is typically lower than that of a traditional spark ignited engine with a propagating flame front and a diesel engine with an attached diffusion flame. The reduced temperature of the burnt gas may result in reduced NOx emissions when operating in the HCCI mode.

Four stroke gasoline internal combustion engines may operate in a controlled auto-ignition combustion mode by employing various valve opening and closing strategies. By altering the operating characteristics of the exhaust valves and/or the intake valves, a high proportion of residual burnt gases or products of combustion may be retained within the cylinder of the internal combustion engine to provide favorable conditions to auto-ignite a highly dilute charge mixture. The range of engine speed and load over which controlled auto-ignition combustion can occur may be expanded by employing various valve operating strategies, thereby obviating the need to increase the compression ratio of the spark ignited internal combustion engine.

One such valve operating strategy is exhaust re-compression. In this mode of operation, the exhaust valve is closed earlier in the exhaust stroke than in a typical four-stroke internal combustion engine. Correspondingly, the intake valve is opened later than in a typical four stroke internal combustion engine. The early exhaust valve closing and late intake valve opening provides a negative valve overlap period where products of combustion become trapped within the engine's cylinder. These trapped products of combustion will mix with the inducted fuel and air charge mixture during the intake stroke of the engine, thereby promoting the auto-ignition process.

Another valve strategy is exhaust re-breathing. In this mode, the exhaust valve is opened for a first period to allow combusted gasses to be expelled from the combustion chamber. Subsequently, the exhaust valve opens for a second period to allow products of combustion previously exhausted from the cylinder to be drawn back into the cylinder. By opening the exhaust valve twice during each four-stroke cycle of the internal combustion engine, the requisite conditions are created within the combustion chamber to support stable auto-ignition combustion.

Yet another valve strategy is a hybrid between exhaust re-compression and exhaust re-breathing. In this mode, the exhaust re-compression mode may be used when the engine is operating at a low engine load. For higher engine loads, the exhaust re-breathing strategy may be used. Additionally, by varying the exhaust valve lift and intake valve phasing, the spark-ignited engine may operate in a non-throttled load control mode (NTLC). In this mode, the intake valve phasing will vary the engine load by controlling the amount of air inducted into the cylinder. At the highest loads, the engine may operate in a traditional spark ignited fashion to enable maximum power density.

To enable the above-mentioned exhaust re-breathing valve strategy, the internal combustion engine may employ cam phasers, a two-step cam system, and a valve re-opening system.

SUMMARY OF THE INVENTION

The present invention is an engine valve actuation system with valve re-opening capability. The system of the present invention does not require a separate high-pressure source of fluid and is flexible in terms of re-opening lift, timing, and duration. The system of the present invention may be applied to either the intake or the exhaust valves and may be applied to either a conventional single lobe cam driven system or a two-step cam driven system. Additionally, the present invention provides a method of re-opening a valve of an internal combustion engine.

Accordingly, provided is a valve actuation system for a poppet valve, which is selectively movable between a closed position and an open position. The valve actuation system includes a reservoir operable to contain a fluid and a first hydraulic device that is in selective fluid communication with the reservoir. Also included is a second hydraulic device, which operates to bias the poppet valve toward the open position from the closed position. The second hydraulic device is in selective fluid communication with the reservoir and the first hydraulic device. An accumulator is in selective fluid communication with the first hydraulic device and the second hydraulic device. The first hydraulic device operates to communicate the fluid to the accumulator for at least a portion of the movement of the poppet valve from the closed position to the open position. The accumulator is operable to communicate the fluid to the second hydraulic device to bias the poppet valve toward the open position from the closed position.

A solenoid valve may operate to selectively communicate fluid between the first hydraulic device, the accumulator, the second hydraulic device, and the reservoir. A camshaft may be provided having base circle portion and a lobe portion and a rocker arm, such as a roller finger follower, may be disposed between the camshaft and the poppet valve. The camshaft rotatably engages the rocker arm and operates to selectively open the poppet valve as the camshaft rotates from the base circle portion to the lobe portion. An electronic control unit may operate to provide control to the solenoid valve. The second hydraulic device may be mounted with respect to an end of the rocker arm opposite the poppet valve and the first hydraulic device may be mounted with respect to the rocker arm between the poppet valve and the second hydraulic device.

A method of re-opening a poppet valve that is selectively movable between a closed position and an open position by a rocker arm engaged with a rotatable camshaft, having a base circle portion and a lobe portion is also provided. The method includes communicating a fluid from a first hydraulic device, in selective communication with a reservoir containing the fluid, to an accumulator for at least a portion of the rotation of the lobe portion of the camshaft into engagement with the rocker arm to facilitate the opening of the poppet valve. The method also includes blocking communication of the fluid between the first hydraulic device and the accumulator after a predetermined time. The method further includes communicating at least a portion of the fluid within the first hydraulic device and a second hydraulic device to the reservoir. The second hydraulic device is operable to engage the rocker arm to bias the poppet valve toward the open position from the closed position. Subsequently, the method includes communicating the fluid from the accumulator to the second hydraulic device to facilitate the re-opening of the poppet valve. The method may also include communicating the fluid from the second hydraulic device to the reservoir to facilitate the closing of the poppet valve subsequent to the re-opening.

The above features and advantages and other features and advantages of the present invention are readily apparent from the following detailed description of the best modes for carrying out the invention when taken in connection with the accompanying drawings.

DESCRIPTION OF THE PREFERRED EMBODIMENT

Figure 1:
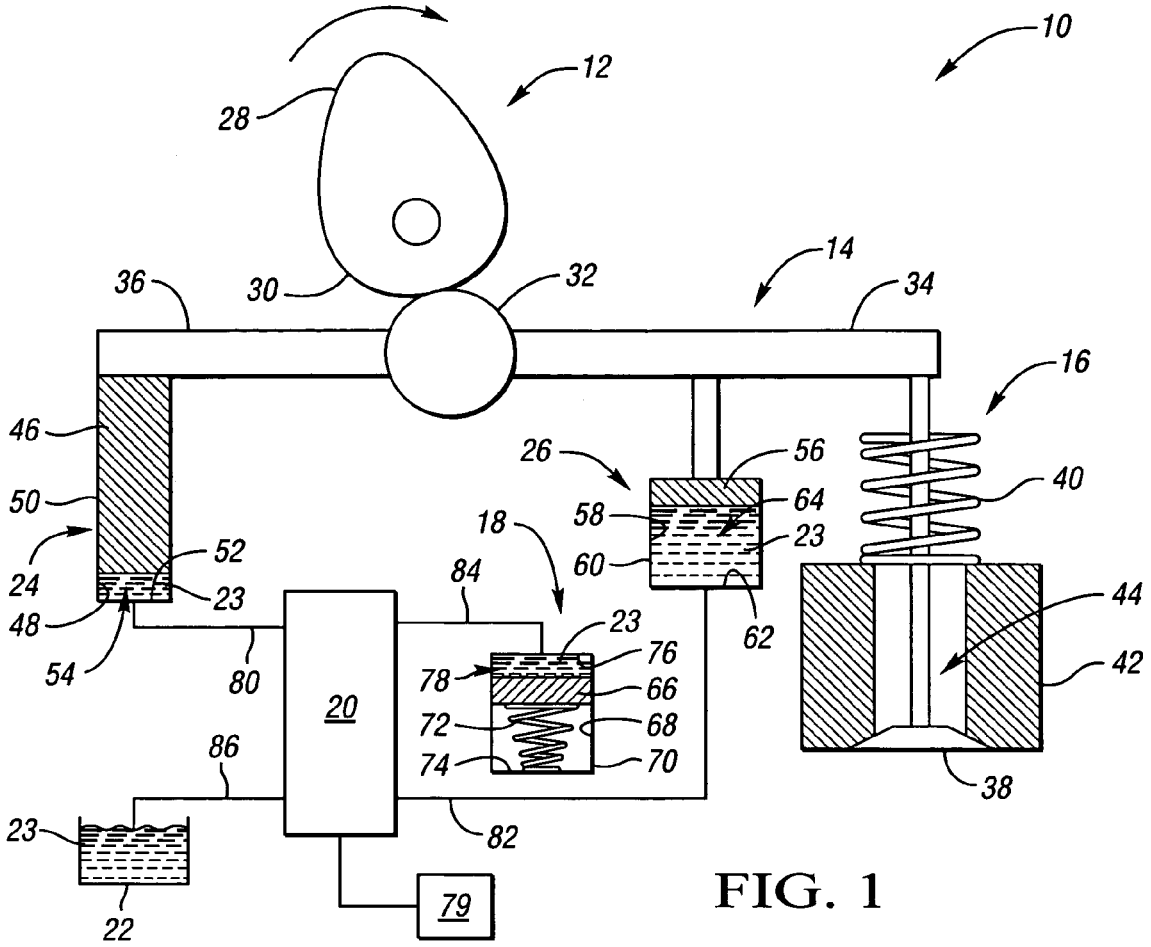
FIG. 1 is a schematic diagrammatic representation of a valve actuation system consistent with the present invention.

Referring to the drawings, and particularly FIG. 1, the reference numeral 10 generally designates a valve actuation system in accordance with the present invention in the context of an internal combustion engine. The valve actuation system 10 includes a camshaft 12, a rocker arm 14 such as a roller finger follower, a valve assembly 16, an accumulator 18, a solenoid valve 20, a reservoir 22 containing a volume of fluid 23, and two hydraulic devices 24 and 26.

The camshaft 12 includes a lobe portion 28 and a base circle portion 30. The camshaft 12 rotatably engages a roller element 32 of the rocker arm 14. The rocker arm 14 has a first arm portion 34 and a second arm portion 36, each disposed on either side of the roller element 32.

The valve assembly 16 includes a poppet valve 38 biased by a valve spring 40 coaxially disposed about the stem of the poppet valve 38. The poppet valve 38 is reciprocally movable within a cylinder head 42 and operates to selectively open and close a port 44 defined by the cylinder head 42. The first arm portion 34 of the rocker arm 14 operates to bias the poppet valve 38 into an open position when the camshaft 12 rotates to engage the roller element 32 with the lobe portion 28, while the valve spring 40 operates to bias the poppet valve 38 into a closed position. Although FIG. 1 only shows one valve, the present invention may be applied to a multi-valve engine while remaining within the scope of that which is claimed.

The hydraulic device 24 contains a piston 46 slidably disposed within a bore 48 defined by a body 50. The piston 46 and bore 48 cooperate with an end plate 52 to define a variable volume cavity 54. The hydraulic device 24 exerts a reaction force on the second arm portion 36 of the rocker arm 14, thereby defining a pivot point. The hydraulic device 26 contains a piston 56 slidably disposed within a bore 58 defined by a body 60. The piston 56 and bore 58 cooperate with an end plate 62 to define a variable volume cavity 64. The piston 56 of the hydraulic device 26 is sufficiently configured to engage the first arm portion 34 of the rocker arm 14.

The accumulator 18 contains a piston 66 slidably disposed within a bore 68 defined by a body 70. A spring 72 is disposed between the piston 66 and an end plate 74 and operates to bias the piston 66 within the bore 68. The piston 66 and bore 68 cooperate with an end plate 76 to define a variable volume cavity 78.

The solenoid valve 20, in the preferred embodiment, is a solenoid actuated spool valve. Such spool valves and their operation are known to those skilled in the art of hydraulic controls. An electronic control unit 79 provides control signals to the solenoid valve 20. The electronic control unit 79 may include a pre-programmable digital computer as is well known in the art of electronic controls. The solenoid valve 20 is in selective fluid communication with the hydraulic devices 24 and 26 through hydraulic ports 80 and 82 respectively. The solenoid valve 20 is in selective fluid communication with the accumulator 18 through a hydraulic port 84. Additionally, the solenoid valve 20 is in selective fluid communication with a reservoir 22 through a hydraulic port 86. The reservoir 22 operates to selectively supply the fluid 23 to, and receive the fluid 23 from the valve actuation system 10.

The valve actuation system 10 of the present invention operates in four modes: charge, store, re-open, and return. To charge the valve actuation system 10, the camshaft 12 rotates such that the lobe portion 28 engages the roller element 32 thereby displacing the rocker arm 14 downwardly from the position as shown in FIG. 1. At this time, the solenoid valve 20 is operating in STATE 1, shown in FIG. 2. The first arm portion 34 of the rocker arm 14 will bias the piston 56 downward within the bore 58. This movement forces the fluid 23 contained within the variable volume cavity 64 to flow into the variable volume cavity 78 of the accumulator 18 by way of the solenoid valve 20. As the fluid 23 fills the variable volume cavity 78, the piston 66 is biased against the spring 72. This "charging" of the valve actuation system 10 will continue until the camshaft 12 rotates to a point of peak valve lift, i.e. the apex of the lobe 28. Additionally, the STATE 1 of the solenoid valve 20 will allow the fluid 23 contained within the variable volume cavity 54 to exhaust to the reservoir 22.

Once peak lift of the poppet valve 38 has been attained, i.e. the camshaft 12 has rotated past the apex of the lobe portion 28, the storage mode commences. The spring 72 biases the piston 66 upwardly within the bore 68, thereby displacing the fluid 23 contained within the variable volume cavity 78 into the variable volume chamber 64 via the solenoid valve 20 in STATE 1. Subsequently, the electronic control unit 79 commands the solenoid valve 20 to switch from STATE 1 to STATE 2, both shown in FIG. 2. At this point, the fluid 23 contained within the variable volume cavity 78 is trapped. The fluid 23 within the reservoir 22 backfills the variable volume cavity 64 via the solenoid valve 20 as the piston 56 moves upwardly in concert with the first arm portion 34 of the rocker arm 14. STATE 2 of the solenoid valve 20 will allow the fluid 23 contained within the variable volume cavity 54 to exhaust to the reservoir 22 as the piston 46 moves downwardly in concert with the second arm portion 36 of the rocker arm 14.

The rocker arm 14 returns to the unbiased position wherein poppet valve 38 is closed as the camshaft 12 rotates to the base circle portion 30, as shown in FIG. 1. When poppet valve 38 re-opening is desired, the electronic control unit 79 commands the solenoid valve 20 from STATE 2 to STATE 3, both shown in FIG. 2. At this point, the spring 72 biases the piston 66 thereby displacing the fluid 23 contained within the variable volume cavity 78 into the variable volume cavity 54 by way of the solenoid valve 20. As the fluid 23 fills the variable volume cavity 54, the piston 46 is biased against the second arm portion 36 of the rocker arm 14. The rocker arm 14 pivots against or about the camshaft 12, acting as a fulcrum, and the arm portion 34 biases the poppet valve 38 against the bias of the valve spring 40. When the force exerted by the arm portion 34 is of sufficient magnitude to overcome the spring force of the valve spring 40, the poppet valve 38 will open. The amount of lift provided to the poppet valve 38 during the re-opening process is dependent upon the amount of the fluid 23 trapped within the variable volume cavity 78. This is determined by the timing, which is typically preprogrammed into the electronic control unit 79, to switch the solenoid valve 20 from STATE 1 to STATE 2 as described hereinabove. Additionally in STATE 3, the solenoid valve 20 allows the fluid 23 contained within the variable volume cavity 64 to exhaust to the reservoir 22 by way of ports 82 and 86.

Figure 2:
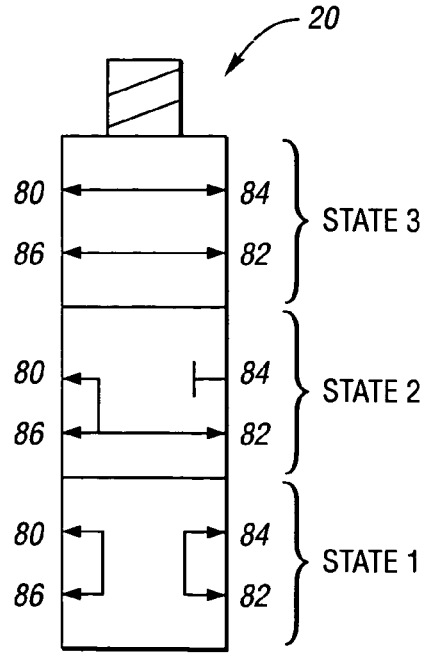
FIG. 2 is a schematic diagrammatic representation of the states of operation of a solenoid valve contained within the valve actuation system shown in FIG. 1.

At the desired return time, the electronic control unit 79 commands the solenoid valve 20 to switch from STATE 3 to STATE 2, shown in FIG. 2. The position of the solenoid valve 20 in STATE 2 enables the fluid 23 within the variable volume cavity 54 to exhaust to the variable volume cavity 64 and the reservoir 22. The valve spring 40 will bias the poppet valve 38 into the closed position, as shown in FIG. 1. Subsequently, the electronic control unit 79 commands the solenoid valve 20 to return to STATE 1, as shown in FIG. 2. The valve actuation system 10 is now in a favorable condition to repeat the process described hereinabove and will continue the process for each subsequent cycle until commanded otherwise by the electronic control unit 79.

The present invention seeks to improve system cost and energy consumption without requiring an additional and separate high-pressure fluid source. The present invention may reduce packaging requirements since the fluid cavities and passages can be arranged with greater flexibility than mechanical linkages. Additionally, the present invention may reduce system cost by controlling the re-opening lift provided to the poppet valve 38 by the switching of the solenoid valve 20, via the electronic control unit, without requiring a valve position sensor. The re-opening lift of the present invention is not substantially affected by pressure variations. The present invention also enables the re-opening timing, lift, and duration to be tailored to the specific engine architecture and operating conditions, which may allow the engine to operate more efficiently.

While the best modes for carrying out the invention have been described in detail, those familiar with the art to which this invention relates will recognize various alternative designs and embodiments for practicing the invention within the scope of the appended claims.

The invention claimed is:

1. A valve actuation system for a poppet valve, which is selectively movable between a closed position and an open position, the valve actuation system comprising:

a reservoir operable to contain a fluid;

a first hydraulic device in selective fluid communication with said reservoir;

a second hydraulic device operable to bias the poppet valve toward the open position from the closed position, said second hydraulic device being in selective fluid communication with said reservoir and said first hydraulic device;

an accumulator in selective fluid communication with said first hydraulic device and said second hydraulic device;

wherein said first hydraulic device is operable to communicate said fluid to said accumulator for at least a portion of the movement of the poppet valve from the closed position to the open position; and wherein said accumulator is operable to communicate said fluid to said second hydraulic device to bias the poppet valve toward the open position from the closed position.

2. The valve actuation system of claim 1, further comprising:

a solenoid valve operable to allow selective communication of said fluid between said first hydraulic device, said accumulator, said second hydraulic device, and said reservoir.

3. The valve actuation system of claim 1, further comprising:

a camshaft having base circle portion and a lobe portion;

a rocker arm disposed between said camshaft and the poppet valve;

wherein said camshaft rotatably engages said rocker arm; and wherein said camshaft is operable to selectively open the poppet valve as said camshaft rotates from said base circle portion to said lobe portion.

4. The valve actuation system of claim 3, wherein said rocker arm is a roller finger follower.

5. The valve actuation system of claim 2, further comprising:

an electronic control unit; and wherein said solenoid valve is controlled by said electronic control unit.

6. The valve actuation system of claim 1, further comprising:

a spring operable to bias the poppet valve into a closed position.

7. The valve actuation system of claim 3, wherein said second hydraulic device is mounted with respect to an end of said rocker arm opposite the poppet valve and said first hydraulic device is mounted with respect to said rocker arm between the poppet valve and said second hydraulic device.

8. A method of re-opening a poppet valve that is selectively movable between a closed position and an open position by rocker arm engaged with a rotatable camshaft, having a base circle portion and a lobe portion, the method comprising:

communicating a fluid from a first hydraulic device, in selective communication with a reservoir containing said fluid, to an accumulator for at least a portion of the rotation of the lobe portion of the camshaft into engagement with the rocker arm to facilitate the opening of the poppet valve;

blocking communication of said fluid between said first hydraulic device and said accumulator after a predetermined time;

communicating at least a portion of said fluid within said first hydraulic device and a second hydraulic device to said reservoir, wherein said second hydraulic device is operable to engage the rocker arm to bias the poppet valve toward the open position from the closed position; and subsequently, communicating said fluid from said accumulator to said second hydraulic device to facilitate the re-opening of the poppet valve.

9. The method of re-opening a poppet valve of claim 8 further comprising:

communicating said fluid from said second hydraulic device to said reservoir to facilitate the closing of the poppet valve subsequent to the re-opening.

10. A valve actuation system for an internal combustion engine comprising:

a poppet valve selectively movable between a closed position and an open position;

a spring coaxially disposed about said poppet valve and operable to bias said poppet valve into said closed position;

a camshaft having a base circle portion and a lobe portion;

a rocker arm having a first arm portion and a second arm portion, said first arm portion being operable to bias said poppet valve;

wherein said camshaft rotatably engages said rocker arm, between said first arm portion and said second arm portion;

wherein said first arm portion biases said poppet valve from said closed position to said open position as said camshaft rotates said lobe portion into engagement with said rocker arm;

wherein said spring biases said poppet valve from said open position to said closed position as said camshaft rotates said base circle portion into engagement with said rocker arm;

a reservoir operable to contain a fluid;

a first hydraulic device in selective fluid communication with said reservoir;

a second hydraulic device mounted with respect to said second arm portion and operable to bias said poppet valve toward said open position from said closed position, said second hydraulic device being in selective fluid communication with said reservoir and said first hydraulic device;

an accumulator in selective fluid communication with said first hydraulic device and said second hydraulic device;

wherein said first hydraulic device is operable to communicate said fluid to said accumulator for at least a portion of the movement of said poppet valve from said closed position to said open position; and wherein said accumulator is operable to communicate said fluid to said second hydraulic device to bias said poppet valve toward said open position from said closed position.

11. The valve actuation system for an internal combustion engine of claim 10, further comprising:

a solenoid valve operable to allow selective communication of said fluid between said first hydraulic device, said accumulator, said second hydraulic device, and said reservoir.

12. The valve actuation system for an internal combustion engine of claim 10, further comprising:

an electronic control unit; and wherein said solenoid valve is controlled by said electronic control unit.

* * * * *